US005627619A

United States Patent [19]

Kimura et al.

[11] Patent Number: 5,627,619

[45] Date of Patent: May 6, 1997

[54] AUTOMATIC PHOTOGRAPHIC DEVELOPING MACHINE

[75] Inventors: Yasuto Kimura; Yoshihiko Nakashima; Yoshifumi Nakamura, all of Wakayama, Japan

[73] Assignee: Noritsu Koki Co., Ltd., Wakayama, Japan

[21] Appl. No.: 675,186

[22] Filed: Jul. 3, 1996

[30] Foreign Application Priority Data

Jul. 10, 1995 [JP] Japan ..... 7-173162

[51] Int. Cl.[6] ..... G03D 3/08

[52] U.S. Cl. ..... 396/620; 226/188; 396/622

[58] Field of Search ..... 354/316, 320, 354/321, 322, 338, 339; 226/188, 189; 134/64 P, 122 P

[56] References Cited

U.S. PATENT DOCUMENTS

| | | | |
|---|---|---|---|
| 3,078,024 | 2/1963 | Sardeson | 226/189 |
| 4,252,429 | 2/1981 | Hope et al. | 354/322 |
| 4,255,039 | 3/1981 | Hope et al. | 354/320 |
| 4,327,989 | 5/1982 | Hope et al. | 354/322 |
| 5,134,430 | 7/1992 | Koizumi | 354/320 |

*Primary Examiner*—A. A. Mathews

*Attorney, Agent, or Firm*—Wenderoth, Lind & Ponack

[57] ABSTRACT

An automatic photographic developing machine allows a rack to be pushed up only if a feed mechanism of such rack is put under excessive load, and is made of fewer parts and is simple in structure. The rack has a feed mechanism for feeding photosensitive material and is inserted in a treating tank. The rack has an input shaft at its upper portion. The input shaft carries a helical gear in mesh with a worm of a drive shaft. A resilient piece made of synthetic resin is supported on a presser holder slidable in the axial direction of the drive shaft. An end of the resilient member is located opposite the end of the input shaft to prevent the rack from being pushed up. If the force urging the rack upward exceeds the resilience of the resilient piece due to an excessive load applied to the feed mechanism, the resilient piece is resiliently deformed by the input shaft. The rack is thus pushed up, and the helical gear is disengaged from the worm.

2 Claims, 7 Drawing Sheets

AUTOMATIC PHOTOGRAPHIC DEVELOPING MACHINE

BACKGROUND OF THE INVENTION

This invention relates to an automatic photographic developing machine for developing photosensitive material such as photographic film.

An automatic photographic developing machine has a plurality of treating tanks arranged in a row and filled with different kinds of treating solutions such as a developing solution, a bleaching agent and a fixer. Photosensitive materials are developed by passing them one after another through racks immersed in the treating solutions in these treating tanks.

As shown in FIG. 6, a rack 40 in each tank has a feed mechanism 41 for feeding photosensitive materials. If the photosensitive materials are films, the feed mechanism 41 comprises a plurality of sprockets 42 which engage square holes formed in leaders to which the leading ends of films are connected to feed the leaders.

The sprockets 42 are rotated by transmitting the rotation of an input shaft 43 supported on the top of the rack 40 through a gear train 44. The input shaft 43 has a driving sprocket 45 adapted to mesh with a chain 47 provided on one side of the treating tank 46 near its top when the rack 40 is inserted in the treating tank 46. The sprocket 45 is thus rotated by moving the chain 47.

While photosensitive materials are being fed by the sprockets 42 in the rack 40, a force that tends to push up the rack 40 acts on the rack. If the rack 40 is pushed up by this force, the driving sprocket 45 will disengage from the chain 47, making it impossible to transmit turning torque from the chain 47 to the sprockets 42 and thus to feed photosensitive materials.

But if the rack 40 is fixed in position to completely prevent it from being pushed up, the gear of the gear train 44 in the feed mechanism 41 may be damaged by being rotated forcibly if the gear train 44 is put under excessive load e.g. due to clogging of a photosensitive material.

To prevent this problem, automatic developing machines are usually provided with a protective means that disengages the driving sprocket 45 from the chain 47 by pushing up the rack 40 only if an excessive load acts on the driving sprocket 45 meshing with the chain 47 or the gear train 44.

FIGS. 6 and 7 show a conventional protective means of this type. It has a guide plate 48 fixed in position on one side of the chain 47 and having a cutout 49 which can accept the end of the input shaft 43 supported on the rack 40.

The protective means further includes a slide plate 50 slidable on the top surface of the guide plate 48 and having a control piece 51 and a cutout 52 wider than the cutout 49. The cutout 52 is partially closed by the end of a presser plate 53 which is vertically movable along a pin 54 protruding from the slide plate 50 and is urged downward by a spring 55.

Normally, the spring-biased presser plate 53 keeps the driving sprocket 45 and thus the rack 40 from being pushed up. If an excessive load acts on the driving sprocket 45 or the gear train 44, the presser plate 53 is pushed up by the input shaft 43, so that the driving sprocket 45 will disengage from the chain 47.

The spring 55 used in such a conventional protective means has to be high in chemical resistance. Thus, its material cost tends to be high. Also, this protective means is made up of a rather large number of parts, and it is troublesome to assemble or replace broken parts.

An object of this invention is to provide an automatic photographic developing machine which allows each rack to be pushed up only if the feed mechanism of each rack is put under excessive load, and which is made up of fewer parts and thus simple in structure.

SUMMARY OF THE INVENTION

According to this invention, there is provided an automatic developing machine for developing photosensitive material comprising a plurality of treating tanks arranged in a row, a driving unit provided at one side of the treating tanks at their upper portion, and racks each having a feed mechanism for feeding the photosensitive material. Each feed mechanism has an input shaft provided with a torque transmission wheel adapted to mesh with the driving unit when the racks are inserted in respective ones of the treating tanks. Presser holders made of a synthetic resin are provided at one side of the driving unit so as to be slidable in a direction in which the tanks are arranged. The presser holders have vertical guide portions into which ends of the input shafts can be inserted, and horizontal guide portions extending from the bottom ends of the vertical guide portions in the direction in which the presser holders slide. Resilient pieces made of a synthetic resin are supported by the presser holders so that their ends will face the ends of the input shafts in the horizontal guide portions.

In another aspect of the invention, there is provided an automatic developing machine for developing photosensitive material wherein each presser holder has a protrusion on a top surface thereof. The protrusions have top surfaces tapered such that the presser holders are slid until the ends of the input shafts are received in the horizontal guide portions by pushing down the protrusions. The treating tanks are housed in a developing box having a top cover provided with presser members adapted to press the tapered surfaces or the protrusions to slide the presser holders until the ends of the input shafts are received in the horizontal guide portions when the top cover is closed.

In the invention, if an upward force acts on one of the racks due to an excessive load that acts on the torque transmission device in the feed mechanism of the rack, the corresponding resilient piece is deformed upward by the input shaft, so that the rack is pushed up and its torque transmission wheel disengages from the driving unit. It is thus possible to prevent damage to the feed mechanism.

According to the invention, by closing the top cover with the racks inserted in the treating tanks and the ends of the input shafts of the racks inserted in the vertical guide portions, the presser members push the tapered surfaces on the protrusions to slide the presser holders until the ends of the shafts are received in the horizontal guide portions. In this state, the ends of the resilient pieces face the ends of the input shafts, preventing the racks from being pushed up. Thus, even if an operator forgets to slide the presser holders to the above position before closing the top cover, they are automatically and reliably moved to the above position by closing the top cover.

The mechanism for preventing the racks from being pushed up according to this invention, consisting of the presser holders and the resilient pieces supported on the presser holders, is made of a small number of component parts and is simple in structure. Besides, both the presser holders and the resilient pieces are molded from a synthetic resin. Thus, this mechanism can be manufactured at a low cost and assembled easily.

Other features and objects of the present invention will become apparent from the following description made with reference to the accompanying drawings, in which:

DETAILED DESCRIPTION OF THE PREFERRED EMBODIMENT

The embodiment of this invention is described with reference to FIGS. 1–4.

Figure 1:
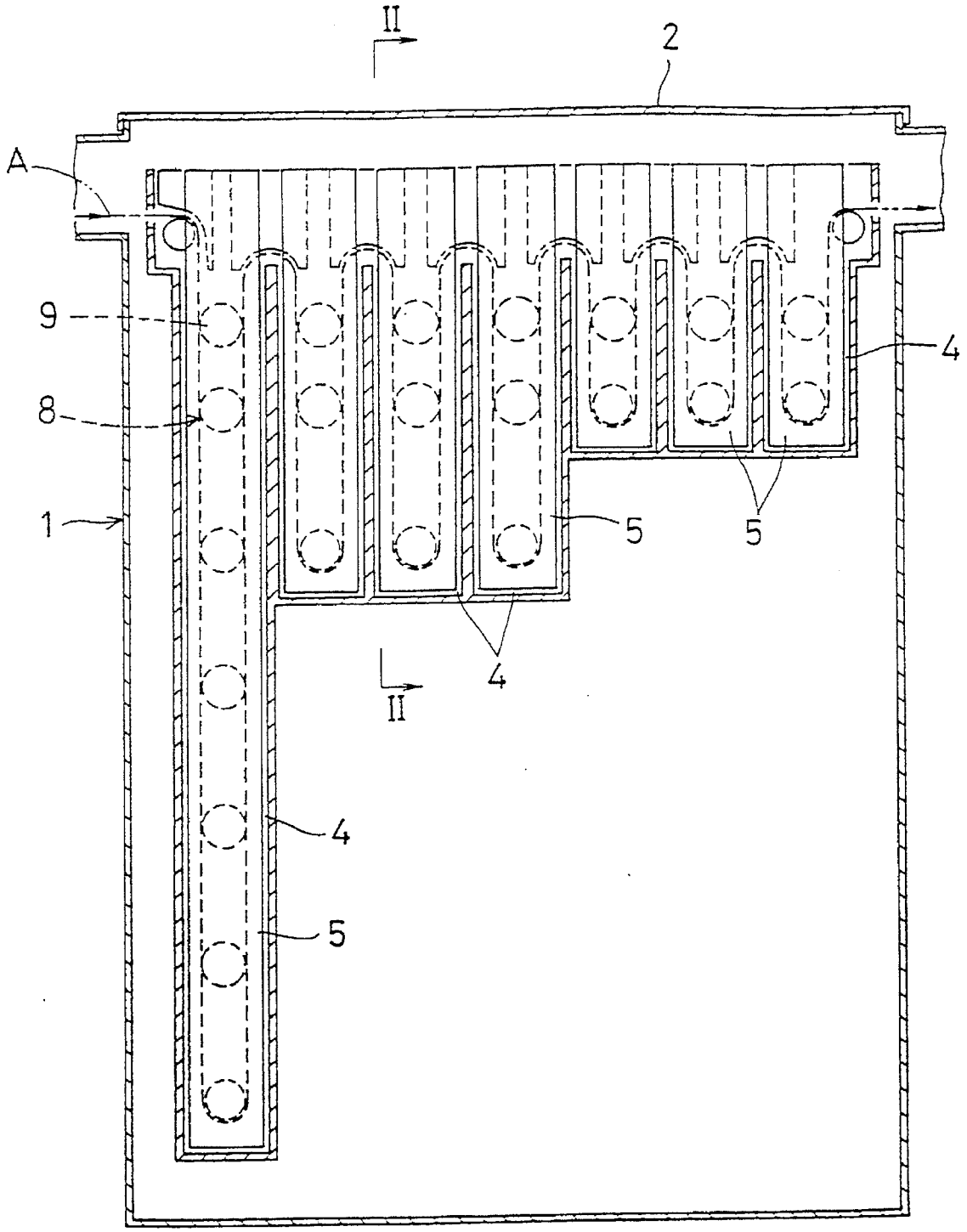
FIG. 1 is a schematic view of the automatic photographic developing machine according to this invention.
Figure 2:
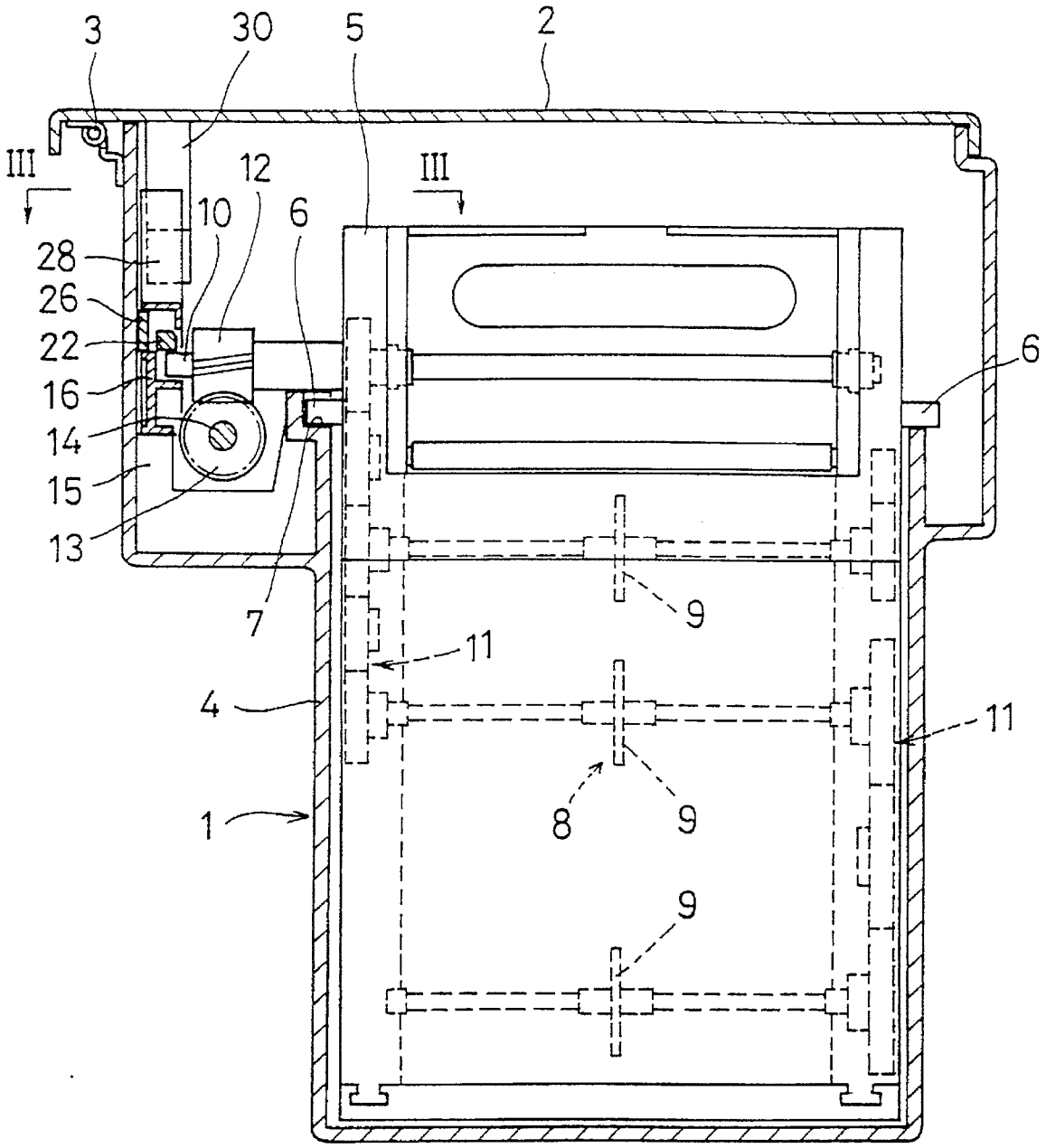
FIG. 2 is a sectional view taken along line II—II of FIG. 1.

First referring to FIG. 1, a developing box 1 has a top opening which is opened and closed by a top cover 2 pivotable about a hinge 3 as shown in FIG. 2.

The developing box 1 houses a plurality of treating tanks 4 arranged in a row. A rack 5 is mounted in each treating tank 4.

A photosensitive material A is developed by being immersed in the treating solutions in the respective tanks 4 while being fed through the developing box 1 along the path in the racks 5 in the tanks 4, shown by chain line in FIG. 1.

As shown in FIG. 2, each rack 5 has a plurality of hanging pins 6 on both sides near its top. The pins 6 on one side are supported in a recess 7 formed in the top of one side wall. The pins 6 on the other side are supported on the top surface of the opposite side wall.

Inside each rack 5 is a feed mechanism 8 for feeding photosensitive material A. Its type is determined according to the kind of photosensitive material A. If the photosensitive material A is a film, use is made of a feed mechanism comprising a plurality of sprockets 9 capable of engaging square holes formed in a leader to which the leading end of a film is connected.

The feed mechanism 8 includes an input shaft 10 rotatably mounted on the upper part of the rack 5, and a gear train 11 through which rotation of the input shaft 10 is transmitted to the sprockets 9.

The input shaft 10 carries a torque transfer wheel in the form of a helical gear 12. The helical gear 12 is in mesh with a driving member or worm 13 provided on one side of the tank 4 near its top.

Figure 3:
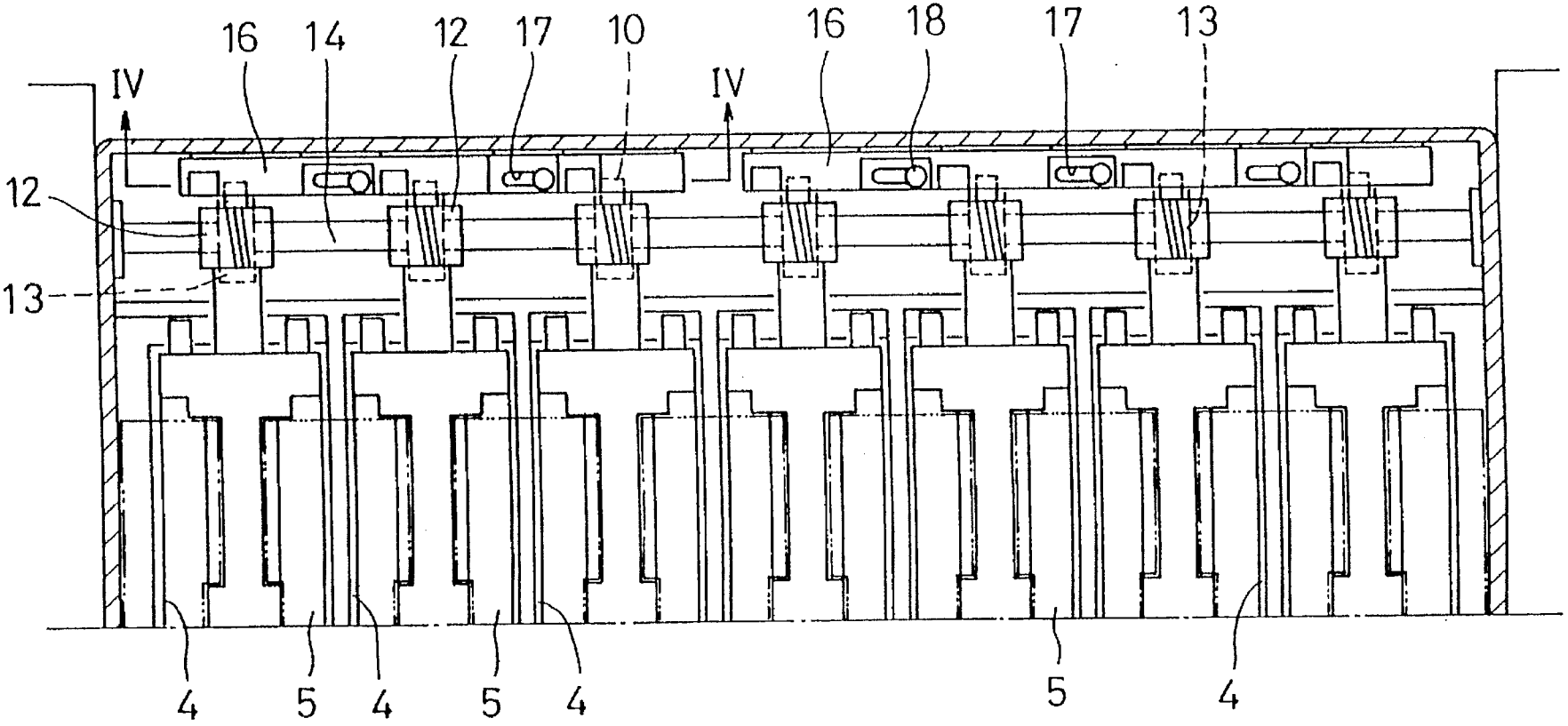
FIG. 3 is a sectional view taken along line III—III of FIG. 2.

The worms 13 of the respective feed mechanisms 8 are supported on a drive shaft 14 which extends as shown in FIG. 3, in the direction in which the treating tanks 4 are arranged. The number of worms 13 is equal to the number of treating tanks 4. By inserting the racks 5 in the respective treating tanks 4, the helical gears 12 mesh with the corresponding worms 13.

The worms 13 and the drive shaft 14 may be replaced with sprockets and a chain in mesh with the sprockets, respectively.

Figure 4:
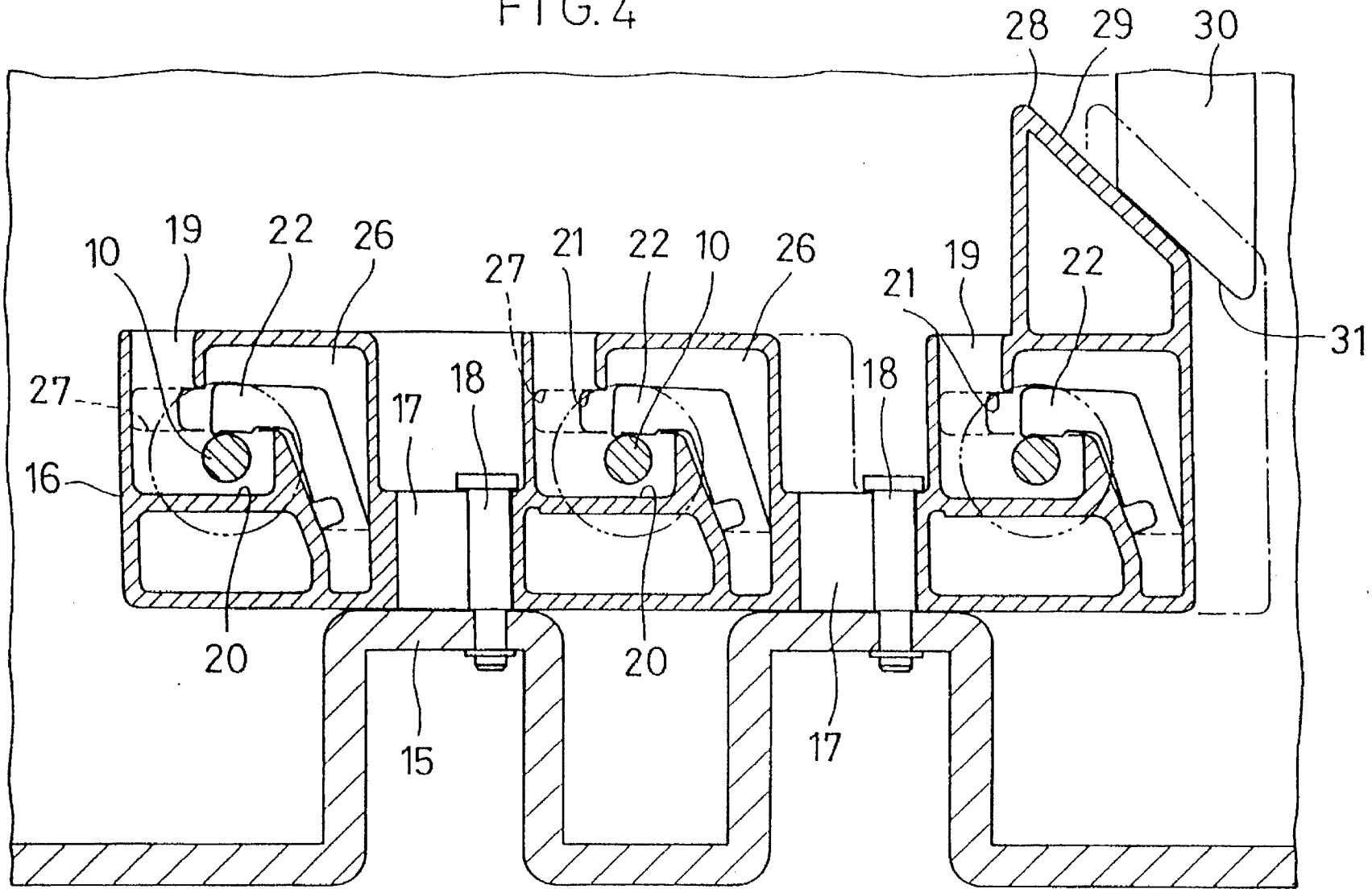
FIG. 4 is a sectional view taken along line IV—IV of FIG. 3.

As shown in FIGS. 2 and 4, a holder support 15 is provided at one side of the drive shaft 14. Presser holders 16 are supported on the holder support 15. Presser holders 16 are arranged in the direction in which the treating tanks 4 are arranged, as shown in FIG. 3.

Figure 5:
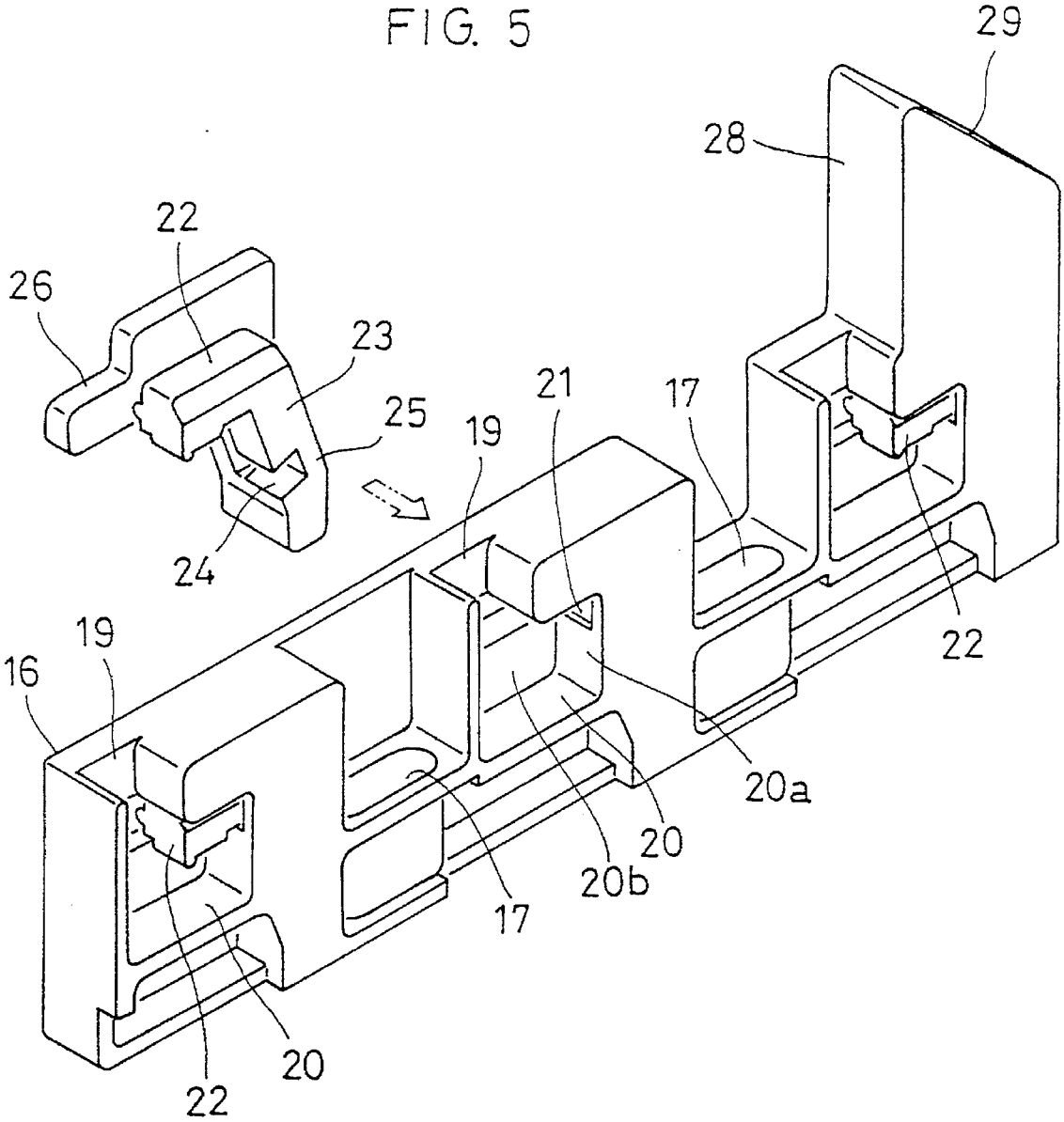
FIG. 5 is an exploded perspective view of a presser holder and a resilient piece.
Figure 6:
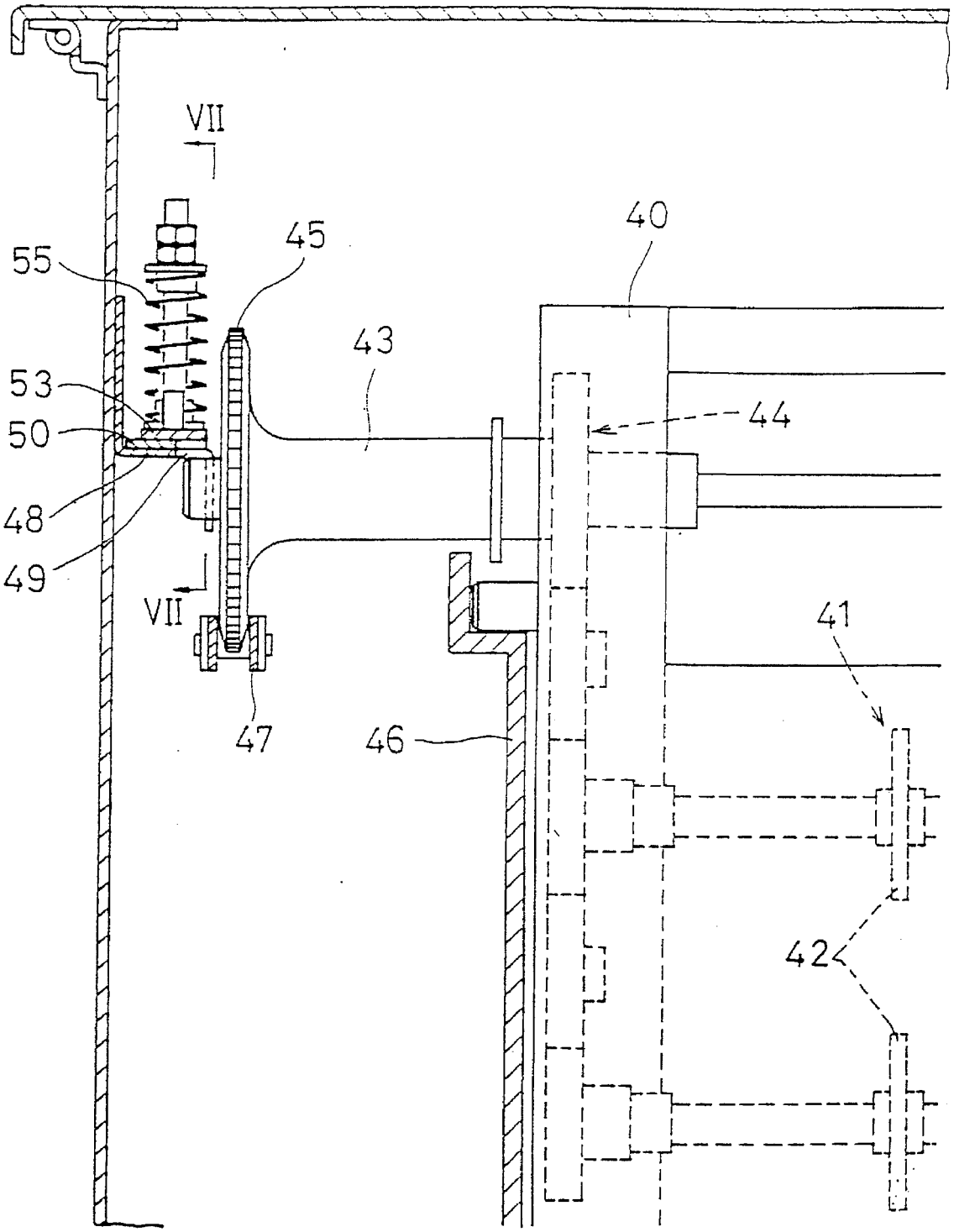
FIG. 6 PRIOR ART
FIG. 6 is a vertical sectional front view of a protective means in a conventional automatic photographic developing machine.
Figure 7:
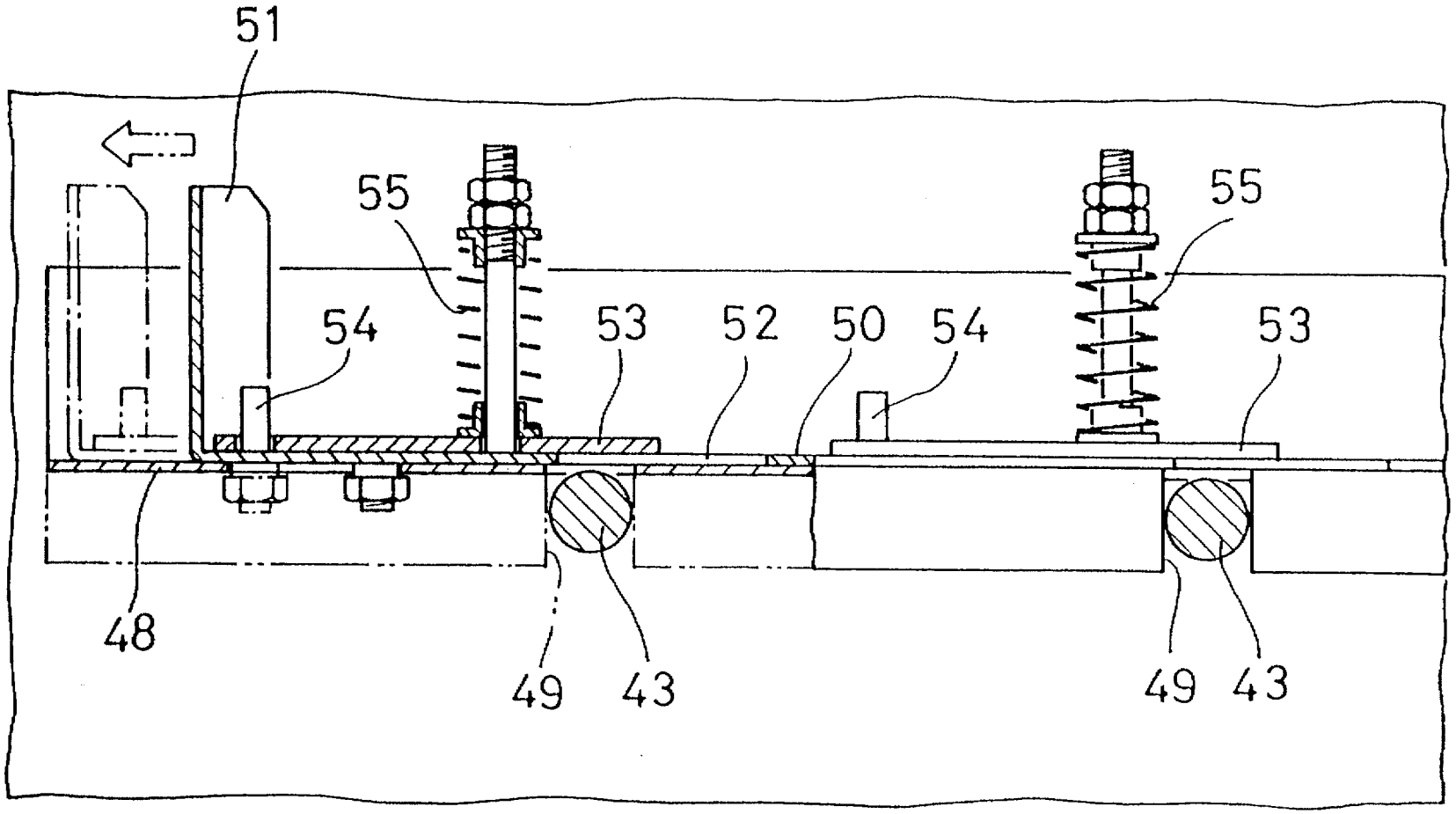
FIG. 7 is a sectional view taken along line VII—VII of FIG. 6.

As shown in FIGS. 4 and 5, each presser holder 16 has holes 17 elongated in the direction the tanks 4 are arranged. Guide shafts 18 protruding from the holder support 15 are received in the respective elongated holes 17 so that the presser holders 16 can slide between the points at which each guide shaft 18 abuts one and the other ends of the elongated hole 17.

The presser holders 16 are molded from a synthetic resin. On the side facing the treating tanks 4, each presser holder 16 has a vertical guide portion 19 into which the end of the respective input shaft 10 can be inserted, and a horizontal guide portion 20 extending from the bottom end of the vertical guide portion 19 in the direction in which each presser holder 16 slides.

A window 21 is formed to extend across the upper parts of a closed end wall 20*a* and a side wall 20*b* of each horizontal guide portion 20. A resilient piece 22 has an end inserted into each horizontal guide portion 20 through its window 21.

As shown in FIG. 5, each resilient piece 22 has an integral downwardly extending leg 23 at its rear end. A cutout 24 is formed at the lower part of the leg 23 to provide a thin portion 25. The resilient piece 22 is thus resiliently deformable or bendable about the thin portion 25.

A support plate 26 is integrally formed at the bottom end of the leg 23, spaced from the resilient piece 22. The support plate 26 fits snugly in a recess 27 (FIG. 4) formed in the backside of each presser holder 16, i.e. the side opposite the side facing the treating tanks 4. By fitting the support plate 26 in the respective recess 27, the end of the resilient piece 22 is adapted to protrude into the upper part of the horizontal guide portion 20.

Each presser holder 16 has a protrusion 28 on its top at one end thereof. The protrusion 28 has a tapered surface 29 at its top that slopes upwardly toward the point at which the end of each input shaft 10 engages in the horizontal guide portion 20.

As shown in FIG. 2, presser members 30 are provided on the underside of the top cover 2, opposite to the protrusions 28 of the holders 16. As shown in FIG. 4, each presser member 30 has a tapered surface 31 complementary to the tapered surface 29. When the top cover 2 is closed with the ends of the input shafts 10 inserted in the vertical guide portions 19, the presser members 30 press the tapered surfaces 29 of the protrusions 28 to move the presser holders 16 until the ends of the input shafts 10 are received in the horizontal guide portions 20.

By putting the racks 5 in the treating tanks 4 through the top opening of the developing box 1, the ends of the input shafts 10 are inserted in the vertical guide portions 19 of the presser holders 16.

With the hanger pins 6 of each rack 5 supported in the recess 7 of the treating tank 4 and on the top surface of the side wall, the presser holders 16 are moved until the ends of the elongated holes 17 abut the guide shafts 18. In this state, as shown in FIG. 4, the input shafts 10 fit in the horizontal guide portions 20, while the ends of the resilient pieces 22 move close to or into contact with the ends of the input shafts 10. In the illustrated embodiment, the ends of the resilient pieces 22 are brought into contact with the ends of the input shafts 10.

Photosensitive material is developed with the top cover 2 closed while keeping the ends of the resilient pieces 22 in contact with the outer peripheries of the input shafts 10 near their ends.

Even if an operator forgets to slide the presser holders 16 in the above manner so that the ends of the resilient pieces 22 are located opposite the ends of the input shafts 10 before closing the top cover 2, the presser holders 16 will be slid automatically by closing the top cover 2 until the ends of the resilient pieces 22 abut the ends of the input shafts 10, because by closing the cover 2, the presser members 30 secured to the top cover 2 press the tapered surfaces 29 of the protrusions 28 of the presser holders 16.

While developing photosensitive material, the racks 5 are subjected to a force that urges them upward due to a load that acts on the gear train 11 for transmitting the rotation of the input shafts 10 to the sprockets 9.

While this upward force is smaller than the resilience of each resilient piece 22 that acts to press each input shaft 10 down, the racks 5 are prevented from being pushed up.

If an excessive load acts on one of the gear trains 11, due e.g. to clogging of photosensitive material A, and as a result the force urging the rack upward exceeds the resilience of the corresponding resilient piece 22, such corresponding resilient piece 22 will be pushed and resiliently deformed by the input shaft 10. The rack 5 is thus pushed up, so that the helical gear 12 disengages from the worm 13. Now, torque is not transmitted to the sprockets 9.

With this arrangement, no excessive load will act on the gear trains 11, so that the gears are kept damage-free.

What is claimed is:

1. An automatic developing machine for developing photosensitive material, said machine comprising:

a plurality of treating tanks arranged in a row, a driving unit provided at an upper portion of one side of said treating tanks, racks each having a feed mechanism for feeding the photosensitive material, each said feed mechanism having an input shaft provided with a torque transmission wheel adapted to mesh with said driving unit when said racks are inserted in respective ones of said treating tanks, presser holders made of a synthetic resin provided at one side of said driving unit so as to be slidable in a direction in which said tanks are arranged, said presser holders having vertical guide portions into which ends of said input shafts can be inserted, and horizontal guide portions extending from bottom ends of said vertical guide portions in the direction in which said presser holders slide, and resilient pieces made of a synthetic resin supported by said presser holders so that ends of said resilient pieces will face ends of said input shafts in said horizontal guide portions.

2. An automatic developing machine for developing photosensitive material as claimed in claim 1, wherein each said presser holder has a protrusion on a top surface thereof, said protrusion having a top surface tapered such that said presser holders are slid until said ends of said input shafts are received in said horizontal guide portions by pushing down said protrusions, and wherein said treating tanks are housed in a developing box having a top cover provided with presser members adapted to press said tapered surface of said each protrusion to slide said presser holders until said ends of said input shafts are received in said horizontal guide portions when said top cover is closed.

* * * * *